US005809057A

United States Patent [19]

Benz et al.

[11] Patent Number: 5,809,057

[45] Date of Patent: Sep. 15, 1998

[54] ELECTROSLAG APPARATUS AND GUIDE

[75] Inventors: Mark Gilbert Benz, Burnt Hills; William Thomas Carter, Jr., Galway; Paul Leonard Dupree, Scotia; Howard Roscoe Hart, Jr., Schenectady; Bruce Alan Knudsen, Amsterdam; Janel Koca Browning, Clifton Park; Russell Scott Miller, Ballston Spa; Robert John Zabala, Schenectady, all of N.Y.

[73] Assignee: General Electric Company, Schenectady, N.Y.

[21] Appl. No.: 712,038

[22] Filed: Sep. 11, 1996

[51] Int. Cl.[6] ..... F27D 3/00

[52] U.S. Cl. ..... 373/142; 373/45; 373/145; 373/156; 75/10.24; 266/201

[58] Field of Search ..... 373/138, 139, 373/142, 146, 151, 155, 156, 163, 42, 43, 44, 45; 75/10.24; 266/201

[56] References Cited

U.S. PATENT DOCUMENTS 5,160,532 11/1992 Benz et al. ..... 75/10.24
5,310,165 5/1994 Benz et al. ..... 266/201
5,325,906 7/1994 Benz et al. ..... 165/270.1
5,332,197 7/1994 Benz et al. ..... 266/201
5,348,566 9/1994 Sawyer et al. ..... 75/10.24
5,366,206 11/1994 Sawyer et al. ..... 266/202
5,563,904 10/1996 Colpo et al. ..... 373/146

*Primary Examiner*—Tu B. Hoang
*Attorney, Agent, or Firm*—Noreen C. Johnson; Douglas E. Stoner

[57] ABSTRACT

A melt guide is provided for enclosing a bottom of an electroslag refining crucible containing a melt of electroslag refined metal. A base plate is sized to have a perimeter to engage the crucible bottom for attachment thereto. The base plate includes an upper surface for defining with the crucible a reservoir for receiving the melt, and a lower surface spaced therebelow. A central drain extends through the base plate for draining by gravity the melt from the reservoir. A plurality of circumferentially spaced apart slots extend radially outwardly from the drain toward the base plate perimeter and extend vertically through the base plate. Induction heating coils are mounted below the base plate lower surface for heating the melt through the slots. The base plate may take various forms including a flat plate, with or without a cooperating and removable insert.

33 Claims, 10 Drawing Sheets

ELECTROSLAG APPARATUS AND GUIDE

BACKGROUND OF THE INVENTION

The present invention relates generally to electroslag refining, and, more specifically, to electroslag refining of superalloys.

Electroslag refining is a process used to melt and refine a wide range of alloys for removing various impurities therefrom. U.S. Pat. No. 5,160,532—Benz et al. discloses a basic electroslag refining apparatus over which the present invention is an improvement. Typical alloys which may be effectively refined using electroslag refining include those based on nickel, cobalt, zirconium, titanium, or iron. The initial, unrefined alloys are typically provided in the form of an ingot which has various defects or impurities which are desired to be removed during the refining process to enhance metallurgical properties thereof including grain size and microstructure, for example.

In a conventional electroslag apparatus, the ingot is connected to a power supply (alternating or direct current, whenever referred to herein) and defines an electrode which is suitably suspended in a water cooled crucible containing a suitable slag corresponding with the specific alloy being refined. The slag is heated by passing an electrical current from the electrode through the slag into the crucible, and is maintained at a suitable high temperature for melting the lower end of the ingot electrode. As the electrode melts, a refining action takes place with oxide inclusions in the ingot melt being exposed to the liquid slag and dissolved therein. Droplets of the ingot melt fall through the slag by gravity, which, whenever referred to herein, may be augmented or diminished by such means as additional pressure above the metal or electromagnetic force. Said droplets are collected in a liquid melt pool at the bottom of the crucible. The slag, therefore, effectively removes various impurities from the melt to effect the refining thereof.

The refined melt may be extracted from the crucible by a conventional induction-heated, segmented, water-cooled copper guide tube. The refined melt extracted from the crucible in this manner provides an ideal liquid metal source for various solidification processes including, for example, powder atomization, spray deposition, investment casting, melt-spinning, strip casting, and slab casting.

In the exemplary electroslag apparatus introduced above, the crucible is conventionally water-cooled to form a solid slag and/or metal skull on the surface thereof for bounding the liquid slag and preventing damage to the crucible itself as well as preventing contamination of the ingot melt from contact with the parent material of the crucible, which is typically copper. The bottom of the crucible typically includes a water-cooled, copper cold hearth against which a solid skull of the refined melt forms for maintaining the purity of the collected melt at the bottom of the crucible. A discharge guide tube below the hearth is also typically made of copper and is segmented and water-cooled for also allowing the formation of a solid skull of the refined melt for maintaining the purity of the melt as it is extracted from the crucible.

A plurality of water-cooled induction heating electrical conduits surround the guide tube for inductively heating the melt thereabove for controlling the discharge flow rate of the melt through the tube. In this way, the thickness of the skull formed around the discharge orifice in the guide tube may be controlled and suitably matched with melting of the ingot for obtaining a substantially steady state production of refined melt which is drained by gravity through the guide tube.

The cold hearth and the guide tube of the conventional electroslag refining apparatus are relatively complex in structure, and are therefore expensive to manufacture. The guide tube typically joins the cold hearth in a conical funnel configuration, with the induction heating coils surrounding the outer surface of the funnel and the downspout through which the melt is drained from the crucible. Such a guide tube requires complex manufacturing processes to build including specialty milling of the various components and fabrication and assembly thereof.

Furthermore, each of the guide tubes segments or fingers must also be suitably manufactured with internal cooling passages therein which adds to the complexity of the assembly and cost of manufacture.

The funnel-shaped guide tube is also subjected to substantial stress and strain during operation from its complex three-dimensional configuration and from the heating and cooling effects of the melt, coolant, and induction heating. The useful life of the copper guide tube is therefore limited, and repair and replacement thereof requires the disassembly of all components in the vicinity thereof to provide access thereto which results in a substantial down-time during a maintenance outage.

Furthermore, the discharge melt is typically simply drained by gravity from the copper guide tube during operation and therefore falls vertically by gravity from the crucible. As indicated above, the refined melt may be used for various subsequent processes including atomization of the melt with a suitable atomizing gas and collection thereof on a suitable workpiece or ingot. Atomization is typically provided by mounting a suitable atomizer ring below the copper guide tube, with the collection ingot being horizontally or obliquely mounted relative thereto for collecting the atomized melt which solidifies thereon. The collection ingot typically requires a relatively complex fixturing arrangement for suitably translating and rotating the ingot during operation for suitably collecting the atomized melt.

It is therefore desirable to reduce the complexity of the guide tube and adjoining cold hearth for reducing the cost of manufacture, and improving the assembly and disassembly process thereof. And, it is desirable to discharge the refined melt from the crucible at an oblique angle so that the collection ingot may instead be mounted vertically in an overall simpler arrangement.

SUMMARY OF THE INVENTION

A melt guide is provided for enclosing a bottom of an electroslag refining crucible containing a melt of electroslag refined metal. A base plate is sized to have a perimeter to engage the crucible bottom for attachment thereto. The base plate includes an upper surface for defining with the crucible a reservoir for receiving the melt, and a lower surface spaced therebelow. A central drain extends through the base plate for draining by gravity the melt from the reservoir. A plurality of circumferentially spaced apart slots extend radially outwardly from the drain toward the base plate perimeter and extend vertically through the base plate. Induction heating coils are mounted below the base plate lower surface for heating the melt through the slots. The base plate may take various forms including a flat plate, with or without a cooperating and removable insert.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which:

FIG. 4 is a bottom view of the melt guide illustrated in

FIG. 2 and taken generally along the line 4—4.

DESCRIPTION OF THE PREFERRED EMBODIMENT(S)

Figure 1:
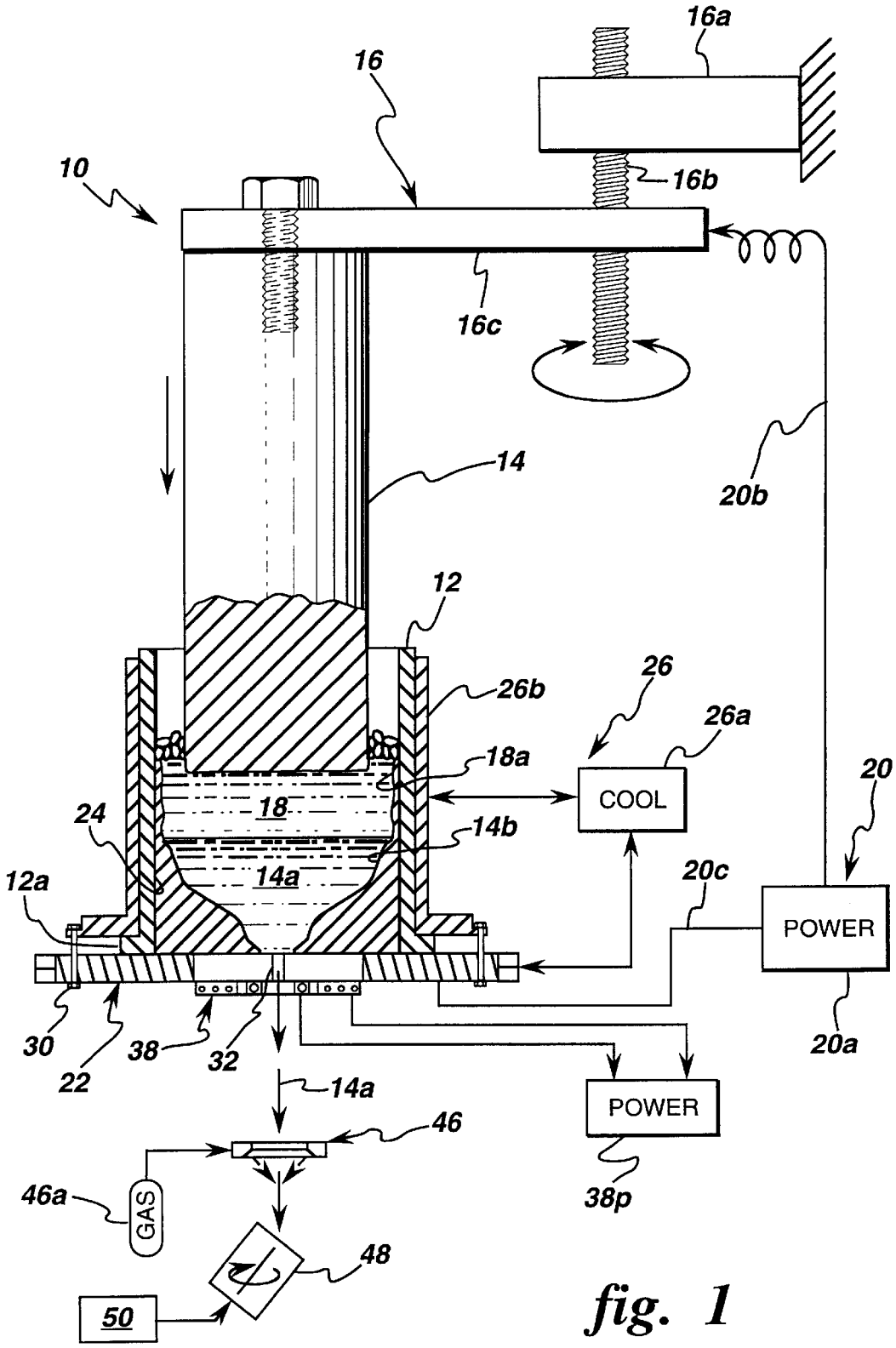
FIG. 1 is a schematic representation of an exemplary electroslag apparatus including an improved base plate in accordance with one embodiment of the present invention for draining refined melt from a crucible.

Illustrated schematically in FIG. 1 is an electroslag refining apparatus 10 in accordance with a preferred and exemplary embodiment of the present invention. The apparatus 10 includes a cylindrical crucible 12 in which is suspended an ingot 14 of a suitable alloy for undergoing electroslag refining. Conventional means 16 are provided for feeding the ingot 14 into the crucible 12 at a suitable feedrate. The feeding means 16 includes, for example, a suitable drive motor and transmission 16*a* which rotate a screw 16*b* which in turn lowers or translates downwardly a support bar 16*c* fixedly joined at one end to the top of the ingot 14.

The ingot 14 is formed of any suitable alloy requiring electroslag refining such as nickel or cobalt based superalloys, for example. A suitable slag 18 is provided inside the crucible 12 and may take any conventional composition for refining a specific material of the ingot 14. Conventional means 20 are provided for melting the tip of the ingot 14 as it is fed into the crucible 12. The heating means 20 include a suitable electrical current power supply 20*a* electrically joined to the ingot 14 through the supporting bar 16*c* by a suitable electrical lead 20*b*. Electrical current is carried through the ingot 14, which defines an electrode, and through the slag 18, in liquid form, to the crucible 12. In this way, the slag 18 is resistively heated to a suitably high temperature to melt the bottom end of the ingot 14 suspended therein.

In accordance with one embodiment of the present invention, an improved melt guide 22 is removably attached to a bottom 12*a* of the crucible 12 for enclosing the bottom thereof. An electrical return path is provided to the power supply 20*a* from the crucible 12 through the melt guide 22, for example, using a suitable electrical lead 20*c*. As the slag 18 is heated by the power supply 20*a*, the bottom tip of the ingot 14 is correspondingly heated and melted, with droplets of molten metal, or simply melt, 14*a* falling through the slag 18 and collecting in a liquid metal pool or reservoir 24 at the bottom of the crucible 12 which is bounded at its bottom end by the melt guide 22.

Suitable means 26 are provided for cooling the crucible 12 during operation. The cooling means 26 includes a suitable coolant supply 26*a* which is effective for pumping a coolant 26*c*, such as water, around the crucible 12 through a cooperating water jacket 26*b*. The crucible 12 and cooling jacket 26*b* may be an integrated assembly or discrete components as desired, with the cooling jacket 26*b* having suitable channels or conduits extending therethrough through which the coolant is circulated for removing heat from the crucible 12 during operation.

In this way, a solid slag skull 18*a* forms during operation inside the crucible 12 around the liquid slag 18 to isolate the crucible 12 from the liquid slag 18 and the metal falling therethrough. Electroslag refining of the ingot 14 is accomplished as the metal droplets melting from the bottom end of the ingot 14 are exposed to the slag 18 which dissolves oxide inclusions therein. The crucible 12 is typically formed of copper and is isolated from the refining process by the solid slag skull 18*a*, and therefore the crucible does not contaminate the ingot melt. The refined ingot melt 14*a* collects in the reservoir 24 at the bottom of the crucible 12 around which is also formed during operation a solid ingot skull 14*b* of solidified refined melt 14*a*. Again, the ingot skull 14*b* isolates the melt 14*a* from the crucible 12 and prevents contamination thereof. In operation, the liquid slag 18 floats atop the pool of refined melt 14*a* collected above the melt guide 22.

Figure 2:
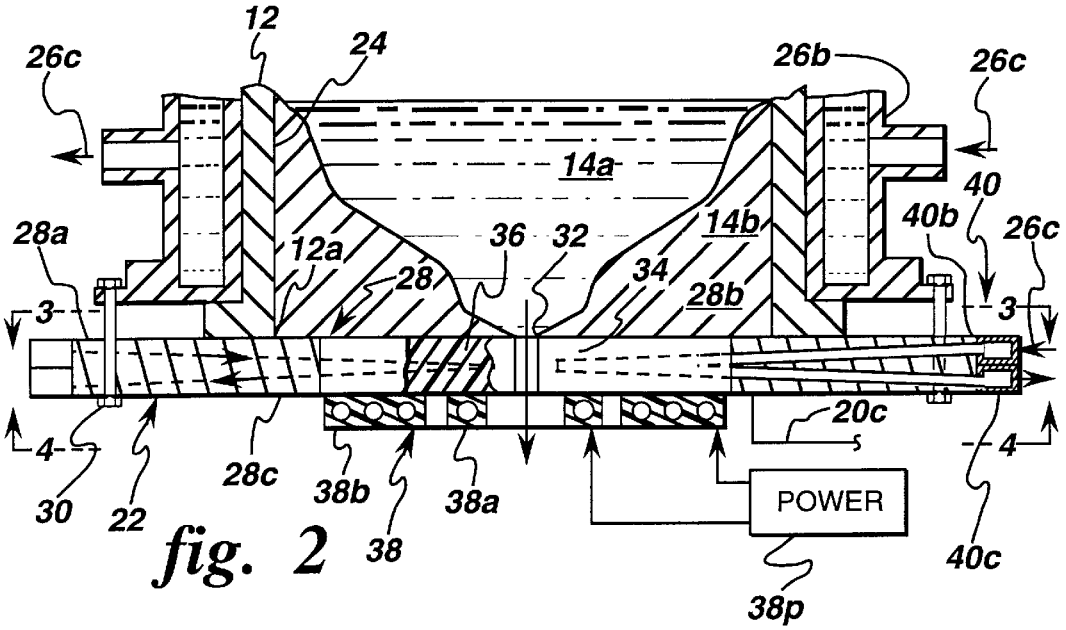
FIG. 2 is an enlarged, elevational sectional view of the base plate illustrated in FIG. 1 attached to the bottom of the crucible in accordance with a preferred embodiment.

The melt guide 22 illustrated in FIG. 1 in accordance with an exemplary embodiment is substantially simpler in construction and manufacture when compared to a conventional funnel-shaped melt guide, and is substantially less expensive to manufacture and more readily assembled and disassembled when required, as well as providing effective operation in the electroslag refining process. FIG. 2 illustrates in more particularity an enlarged view of the melt guide 22 enclosing the bottom 12*a* of the crucible 12. In this exemplary embodiment, the crucible 12 is a solid cylindrical member, with its bottom 12*a* being in the form of an annular radial flange. The coolant jacket 26*b* is in the exemplary form of a double walled cylinder surrounding the crucible 12 and is hollow for receiving the coolant 26*c* therethrough for cooling the crucible 12 during operation.

In its simplest embodiment, the melt guide 22 includes a substantially flat base plate 28 which may be made of copper, for example. The base plate 28 is in the exemplary form of a circular disk to match the cylindrical crucible 12, and has a perimeter 28*a* sized in diameter to engage the crucible bottom 12*a* for sealed attachment thereto. Suitable means 30 in the exemplary form of a plurality of circumferentially spaced apart fasteners or bolts and cooperating nuts are provided for removably attaching the base plate 28 to the crucible bottom 12*a* in sealed contact therewith. In the exemplary embodiment illustrated in FIG. 2, the fasteners 30 extend through a corresponding plurality of apertures in the perimeter of the base plate 28 which are aligned with corresponding apertures disposed in a suitable annular flange around the base of the coolant jacket 26*b*. A suitable gasket or seal may be provided between the base plate 28 and the crucible bottom 12*a* and is compressed therebetween upon assembly of the fasteners 30 to secure the base plate 28 to the bottom of crucible 12.

The base plate 28 further includes an internal or upper surface 28*b* which defines with the crucible 12 the reservoir 24 for receiving and pooling the melt 14*a* therein. The base plate 28 also includes an external or lower 28*c* spaced below the upper surface 28*b*, and in the exemplary embodiment illustrated in FIG. 2 both surfaces are substantially flat and parallel to each other.

The base plate 28 further includes a central orifice or drain 32 extending vertically therethrough between the upper and lower surfaces for draining by gravity the melt 14*a* from the reservoir 24. Extending radially outwardly from the drain 32 toward the perimeter of the base plate are a plurality of preferably equiangularly, circumferentially spaced apart slots 34 shown in more particularity in FIGS. 3 and 4 which also extend vertically completely through the base plate 28. In the exemplary embodiment illustrated in FIGS. 2–4, there are four slots 34 disposed 90 degrees apart from each other. In alternate embodiments, any suitable number of the slots 34 may be utilized. The slots 34 may be gas filled, or filled with an electrical insulation 36 taking any suitable form such as a polymer of epoxy, for example.

Figure 4:
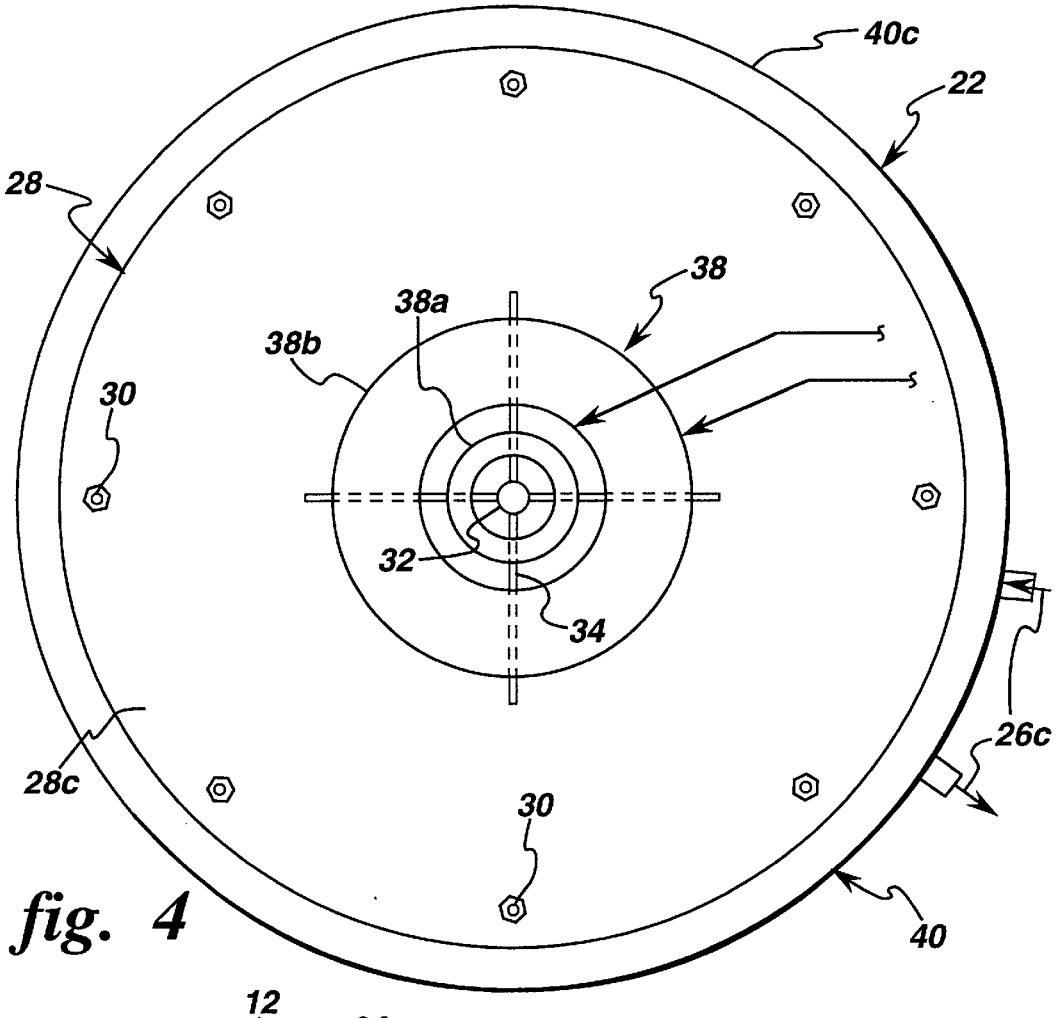

As shown in FIGS. 2 and 4, suitable means 38 are disposed below the base plate lower surface 28*c* for induction heating the melt 14*a* in the reservoir 24 through the slots 34. As shown in FIG. 4, the slots 34 have a radial extension suitably selected for transmitting electromagnetic energy therethrough into the melt 14*a* over the majority of the diameter within the crucible 12. The heating means 38 may take any conventional form including annular or spiraling, water cooled electrical conductors or coils disposed coaxially about the drain 32, and extending radially over the slots 34 as illustrated in FIG. 4. As shown in FIG. 1, the induction heating means 38 include one or more suitable power supplies 38*p* for providing suitable electrical current therethrough for effecting induction heating of the melt 14*a* through the slots 34. The induction heating coils are conventionally hollow and conventionally circulate therethrough a suitable coolant such as water for effecting long term operation.

As illustrated in FIG. 2, a significant advantage of the present invention is the substantial simplification of the melt guide 22 itself. In its simplest embodiment, the melt guide 22 is in the form of a flat base plate 28 which may be simply manufactured from plate metal such as copper. The drain 32 may be in the form of a simple cylindrical orifice which may be readily manufactured using simple drilling. Simple drilling of the drain 32 provides a cylindrical orifice which is perpendicular to both the upper and lower surfaces 28*b* and 28*c* of the base plate 28. The refined melt 14*a* therefore flows straight downwardly by gravity from the drain 32 during operation.

And, the several slots 34 may also be readily formed using conventional electrodischarge machining (EDM) in which a suitable wire is inserted through the drain 32 and slice forms or cuts each of the slots 34 using electrodischarge machining. Each slot 34 may then be suitably filled with the electrical insulation 36 in the exemplary form of conventional epoxy.

The induction heating coils 38 may be simply attached or disposed along the base plate lower surface 28*c* concentrically around the drain 32 and over the radial extent of the slots 34 for transmitting electromagnetic energy through the slots 34 and into the melt 14*a* thereabove. In this way, induction heating of the melt 14*a* into and through the drain 32 may be controlled for controlling the thickness of the ingot skull 14*b* above the base plate 28 as well as through the drain 32. The draining flow rate of the melt 14*a* may thereby be accurately controlled for achieving a steady state operation of the electroslag refining corresponding with the melting rate of the ingot 14.

The substantial simplicity of the flat melt guide 22 substantially decreases its cost of manufacture, including decreasing the cost of assembly and disassembly thereof. The base plate 28 may be readily replaced during a maintenance outage by simply disassembling the fasteners 30 and removing the entire melt guide 22 including the base plate 28 and induction coils 38. The induction coils 38 themselves may be suitably removably fixedly joined to the bottom of the base plate 28 and readily removed and replaced as desired.

Figure 3:
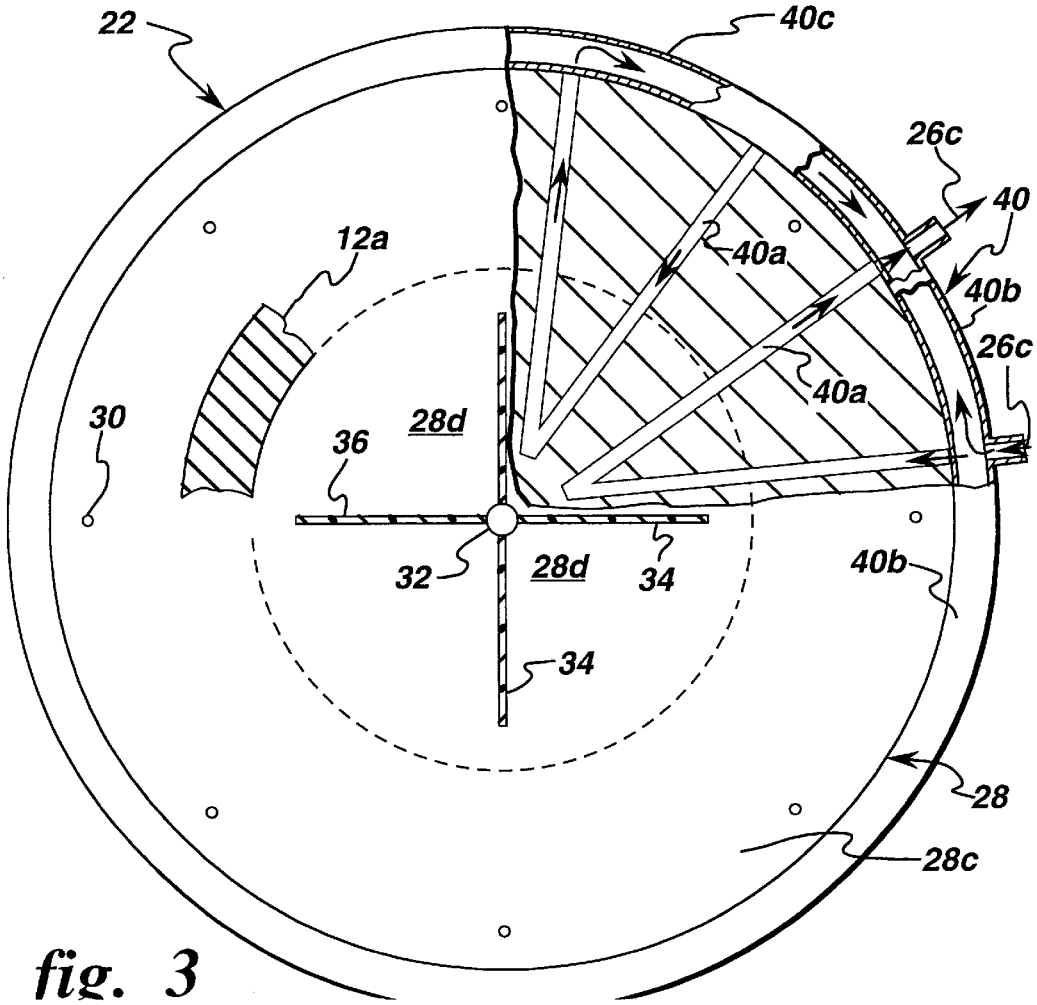
FIG. 3 is a top, partly sectional view of the melt guide illustrated in FIG. 2 and taken generally along line 3—3.

As shown in FIGS. 2 and 3, the melt guide 22 preferably also includes suitable means 40 for cooling the base plate 28 against the heating effects of the melt 14*a*. Suitable induction heating of the melt 14*a* through the slots 34 and cooling of the base plate 28 itself around the drain 32 are balanced for controlling the draining flow rate of the melt 14*a* through the drain 32 during startup and steady state operation of the electroslag refining apparatus.

As shown in FIG. 3, the slots 34 define a plurality of arcuate segments or fingers 28*d* therebetween, with four fingers 28*d* being defined between the corresponding four slots 34. Each finger 28*d* is in the form of a 90 degree corner, and the cooling means 40 include suitable channels 40*a* extending inside each of the fingers 28*d* for circulating a coolant such as the water 26*c* therethrough. The plate cooling means 40 may use its own source of coolant or may be disposed in parallel with the cooling supply 26*a* which cools the crucible 12.

The cooling channels 40*a* illustrated in FIG. 3 may be simply manufactured by drilling cylindrical holes radially inwardly from the outer perimeter of the base plate 28. Adjacent channels 40*a* may converge together radially inwardly and intersect near the drain 32 to provide corresponding supply and return paths for the coolant. The individual channels 40*a* may be suitably joined to a coolant supply and coolant sump. In the exemplary embodiment illustrated in FIG. 3, the cooling means 40 also includes a pair of coolant manifolds 40*b* and 40*c* which may be integrally formed with the base plate 28 or suitably attached thereto around the perimeter thereof, with the supply manifold 40*b* being disposed and flow communication with respective ones of the channels 40*a* for supplying the coolant thereto, and the return manifold 40*c* being disposed and flow communication with corresponding channels 40*a* for receiving the return coolant therefrom. The manifolds 40*b,c* are suitably connected to the coolant supply 26*a* for circulating the coolant therethrough.

Referring again to FIGS. 2 and 4, the induction heating means 38 preferably includes independent primary and secondary ones of the coils, designated 38*a* and 38*b*. The primary and secondary coils 38*a*, 38*b* may take any conventional form having water cooled, current carrying conduits disposed in a suitable configuration such as the flat configuration illustrated in the figures. The primary coil 38*a* is preferably disposed closely adjacent to and surrounding the drain 32 for heating the melt 14*a* discharged therethrough and controlling the thickness of the corresponding skull therein. The secondary coil 38*b* is spaced radially outwardly from the primary coil 38*a* and has a sufficient number of turns and radial extent overlapping the radial extent of the slots 34 for suitably heating the melt 14*a* in the reservoir 24 around the drain 32, and correspondingly controlling the thickness of the ingot skull 14*b*.

Figure 5:
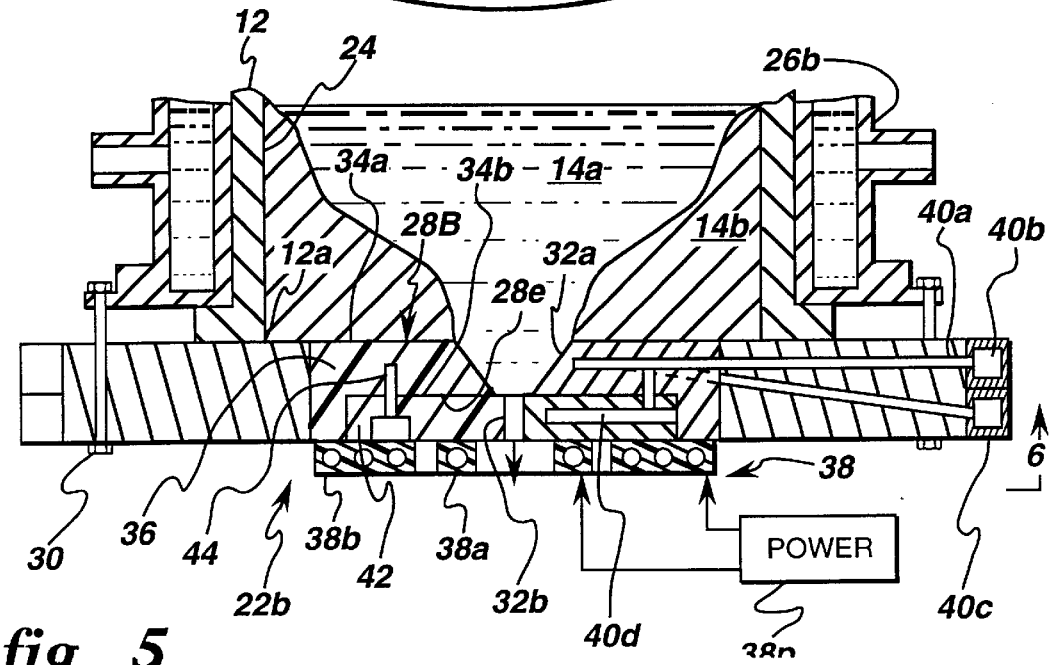
FIG. 5 is a elevational, sectional view of the bottom of the crucible illustrated in FIG. 1, with a melt guide in accordance with a second embodiment of the present invention.
Figure 6:
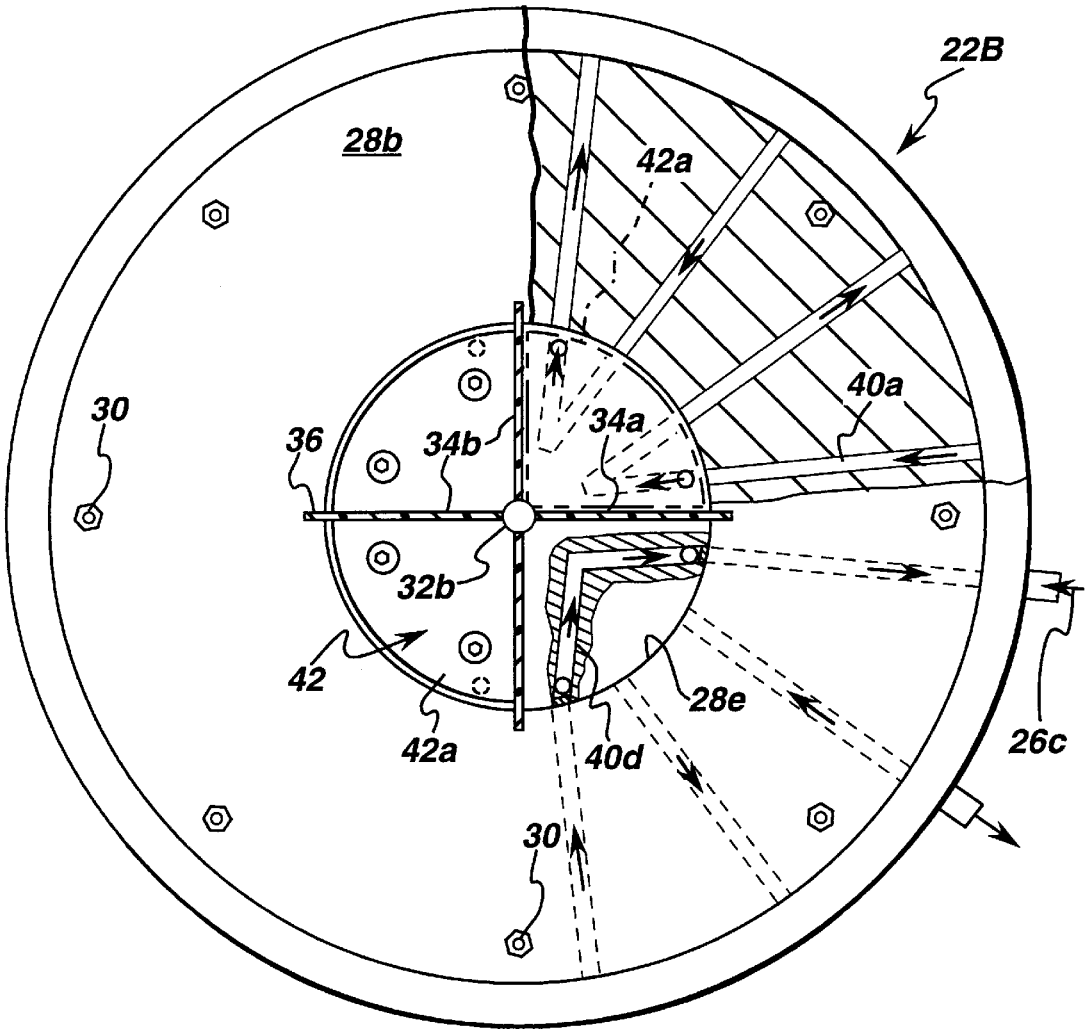
FIG. 6 is a bottom, partly sectional view of the melt guide illustrated in FIG. 5 and taken generally along line 6—6.

FIGS. 5 and 6 illustrate an alternate embodiment of the melt guide designated 22B which again includes a base plate similar to the base plate 28 described above with suitable modifications. The base plate is therefore designated 28B, and is also referred to as an upper plate 28B which includes an annular counterbore or recess 28*e* disposed in the lower surface thereof around the drain which defines an upper drain 32*a*, with the slots therein defining upper slots 34*a*. In this embodiment, the melt guide 22B further includes an insert 42 in the exemplary form of a lower plate suitably fixedly joined to the base plate 28B in the counterbore 28*e* using suitable recessed machine screws 44, for example. The insert 42 is complementary in configuration with the counterbore 28*e* and includes a lower orifice or drain 32*b* disposed in flow communication with the upper drain 32*a* for receiving and draining by gravity the melt 14*a* channeled therethrough.

The insert 42 further includes a plurality of circumferentially spaced apart lower slots 34*b* extending radially outwardly from the lower drain 32*b* as illustrated in more particularity in FIG. 6, and aligned with respective ones of the upper slots 34*a* for transmitting without obstruction therethrough the electromagnetic energy from the induction heating means 38 to the melt 14*a* in the reservoir 24. The heating means 38 are preferably disposed around the insert 42 and therebelow as illustrated in FIG. 5 for transmitting the electromagnetic energy upwardly through the lower and upper slots 34*b* and 34*a*, in turn.

In the exemplary embodiment illustrated in FIGS. 5 and 6, the cooling means 40 are additionally configured for also cooling the insert 42 using additional coolant channels 40*d*. The insert 42 may be separately cooled from the base plate 28B, but in the preferred embodiment illustrated in the figures, the insert cooling means, including the channels 40*d*, are disposed in flow communication with the plate cooling means, including the channels 40*a* therein, for circulating the coolant therebetween. The insert cooling channels 40*d* may be simply formed by drilling radially inwardly from the perimeter of the insert inclined holes which intersect each other near the lower drain 32*b*. The insert channels 40*d* may be independently disposed in flow communication with the coolant supply 26*a*, or may be configured to join the plate channels 40*a* as illustrated in FIG. 5. In this exemplary embodiment, vertical holes are drilled in the top of the insert 42 and into the insert channels 40*d*, with corresponding vertical holes drilled upwardly in the counterbore 28*e* to intersect the plate channels 40*a*. The radially outer ends of the insert channels 40*d* as illustrated in FIG. 5 are suitably plugged to prevent leakage therefrom and the vertical holes joining the channels 40*a* and 40*d* are suitably aligned and provided with suitable O ring seals, for example, for providing a fluid tight connection therebetween. Other suitable arrangements may be provided for channeling the coolant through both the base plate 28B and the insert 42 for providing effective cooling thereof. And, any suitable seal may be otherwise provided between the insert 42 and base plate 28B to provide a seal against ambient external gas backflow.

As shown in FIG. 6, the insert 42 preferably comprises a plurality of discrete arcuate segments 42*a* circumferentially spaced apart from each other at respective ones of the lower slots 34*b*. In the exemplary embodiment illustrated, each of the segments 42*a* is a 90 degree quadrant of a circle, with each being fixedly joined to the base plate 28B in the counterbore 28*e* by the recessed screws 44. As shown in both FIGS. 5 and 6, the lower slots 34*b* extend the full radial extent of the insert 42 dividing it into the four separate segments 42*a*, with the upper slots 34*a* being radially greater in length than the lower slots 34*b* to correspond with the radial extent of the induction heating means 38.

In this embodiment, the insert segments 42*a* collectively define a segmented flat disk which includes a lower surface extending radially between the lower drain 32*b* and the outer perimeter of the insert 42, with the disk lower surface being disposed substantially coplanar with the lower surface of the base plate 28B between the counterbore 28*e* and the perimeter thereof. The base plate 28B and the insert 42 therein are therefore completely flat along the entire top and bottom surfaces thereof. Accordingly, the second melt guide 22B illustrated in FIG. 5 is substantially similar in overall configuration and function to the first melt guide 22 illustrated in FIG. 2, but with removable insert segments 42*a*. In this way, the base plate 28B may remain attached to the crucible 12 during a maintenance outage with only the insert segments 42*a* being replaced as they wear during operation, or replaced if it is desired to change the effective diameter of the lower drain 32*b*. The upper drain 32*a* is therefore suitably larger than the lower drain 32*b* for allowing differently sized lower drains 32*b* to be installed therewith. The upper drain 32*a* may itself also be cylindrical in configuration or may have a conical or funnel-shape as illustrated in FIG. 5 if desired. The lower drain 32*b* may be cylindrical or any other desired shape.

Either embodiment of the melt guides 22 and 22B may be used in the electroslag refining apparatus 10 illustrated in FIG. 1 and used in conjunction with any subsequent processing of the refined melt 14*a* discharged therefrom. For example, conventional means 46 may be provided for injecting a suitable atomizing gas from a gas supply 46*a* to atomize the refined melt 14*a* discharged from the drain 32. In FIG. 1, the atomizing means 46 are spaced below and are separate from the melt guide 22, and are disposed vertically above conventional collection ingot or workpiece 48. The workpiece 48 is conventionally mounted in a fixture 50 either horizontally or at an inclination, with the fixture 50 including suitable means for rotating the workpiece 48 about a longitudinal centerline axis thereof and translating the workpiece 48 for suitably collecting the atomized melt 14*a* which solidifies thereon.

Figure 7:
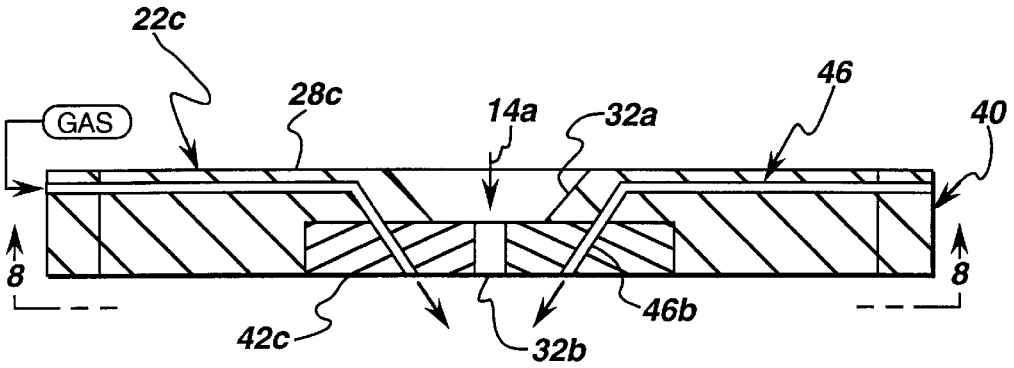
FIG. 7 is an elevational, sectional view of a melt guide in accordance with a third embodiment of the present invention similar to the embodiment illustrated in FIGS. 5 and 6, and further including integrated atomizing channels for discharging an atomizing gas around the draining melt.
Figure 8:
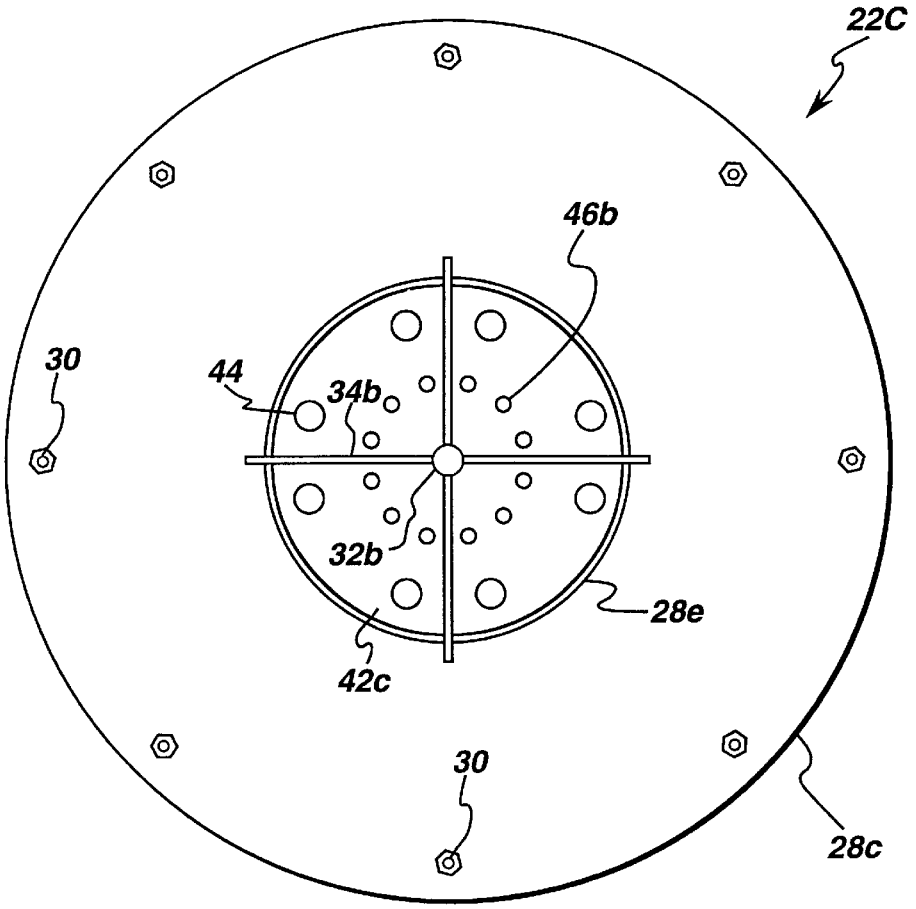
FIG. 8 is a bottom view of the melt guide illustrated in FIG. 7 and taken generally along line 8—8.

FIGS. 7 and 8 illustrate a third embodiment of a melt guide, designated 22C, which is substantially identical to the second embodiment of the melt guide 22B illustrated in FIGS. 5 and 6, except that the atomizing means are disposed in part in the insert, designated 42C, for injecting the atomizing gas therefrom around the lower drain 32*b* to atomize the refined melt 14*a* upon discharge therefrom. In this embodiment, the atomizing means further comprise a plurality of circumferentially spaced apart outlets 46*b* as shown in FIG. 8 disposed in a ring coaxially about the lower drain 32*b* in the insert lower surface. The gas outlets 46*b* are suitably inclined radially outwardly and upwardly into the insert 42C for converging the discharged atomizing gas around the discharged melt 14*a*. The gas outlets 46*b* as illustrated in FIG. 7 may extend upwardly into the base plate 22C with suitable O-ring seals therebetween and then extend radially outwardly through the base plate 22C in suitable flow communication with the gas supply 46*a*. In this way, the atomizing gas is coupled with the discharged melt 14*a* in the common melt guide 22C. And, the gas outlets 46*b* are readily formed in the insert 42C using simple drilling equipment.

Figure 9:
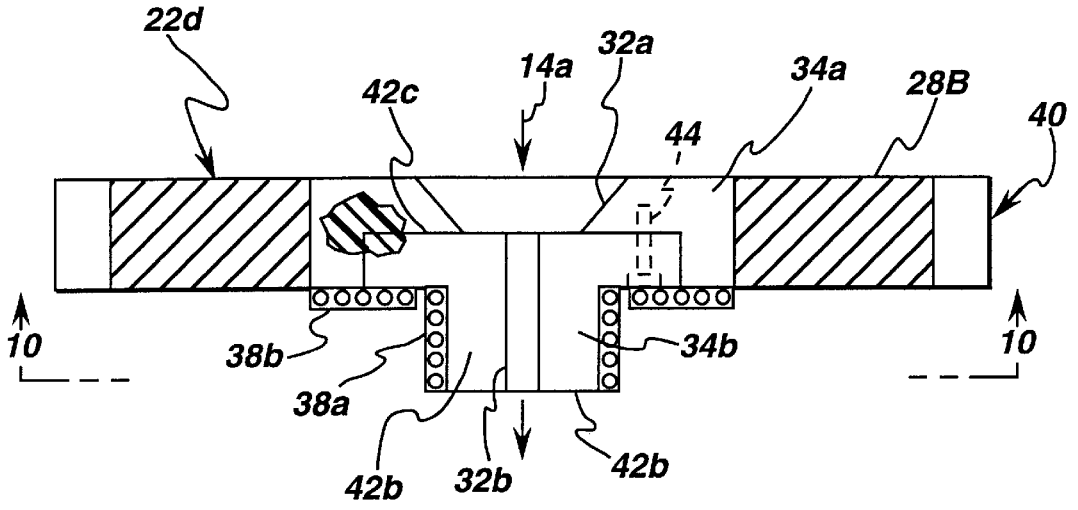
FIG. 9 is an elevational, partly sectional view of a melt guide in accordance with a fourth embodiment of the present invention configured for attachment to the bottom of the crucible illustrated in FIG. 1, and showing an insert in the form of a cylindrical extension extending from the bottom of the base plate.
Figure 10:
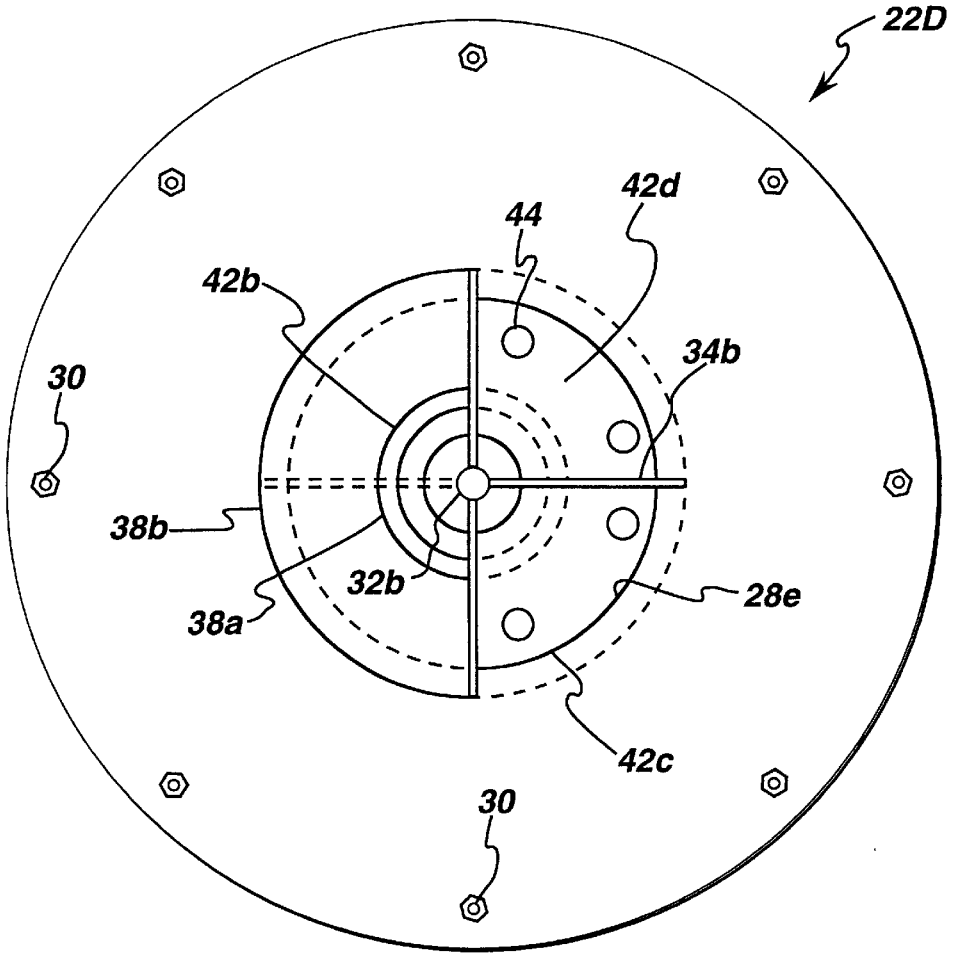
FIG. 10 is a bottom view of portions of the melt guide illustrated in FIG. 9 and taken generally along line 10—10.

Illustrated in FIGS. 9 and 10 is yet another embodiment of a melt guide designed 22D which is similar to the melt guide 22B illustrated in FIGS. 5 and 6, except that the insert has a different configuration and is designated 42D. The four arcuate segments of the insert 42D collectively define a segmented cylinder or extension 42*b* extending from a larger diameter annular flange 42*c*, with the insert flange 42*c* being fixedly mounted by the screws 44 coplanar in the plate counterbore 28*e* like the insert 42 illustrated in FIG. 5. The segmented cylinder 42*b* extends downwardly therefrom for increasing the vertical length of the lower drain 32*b*.

In this embodiment, the primary coil 38*a* is disposed circumferentially around the insert cylinder 42*b* and the lower drain 32*b* extending therethrough for heating the melt 14*a* through portions of the lower slots 34*b* joining the lower drain 32*b*. The secondary coil 38*b* is disposed circumferentially around the insert flange 42*c* for heating the melt 14*a* in the reservoir 24 through portions of the lower slots 34*b* in the flange 42*c*, and through the upper slots 34*a* aligned therewith.

In this way, the secondary coils 38*b* extend horizontally below the upper slots 34*a* and the flange portions of the lower slots 34*b* for transmitting electromagnetic energy into the melt 14*a* in the reservoir 24. The primary coils 38*a* extend vertically along the cylindrical extension 42*b* and transmit electromagnetic energy into the melt 14*a* being carried through the lower drain 32*b* for controlling the thickness of the skull formed therein and thereby controlling the draining flow rate of the melt 14*a*.

In the exemplary embodiment illustrated in FIGS. 9 and 10, the upper drain 32*a* and the lower drain 32*b* are coaxial and extend straight through the base plate 28B and the insert 42D. The melt guide 22D may therefore be used directly in the electroslag refining apparatus 10 illustrated in FIG. 1 instead of the first embodiment of the melt guide 22 shown therein.

Figure 11:
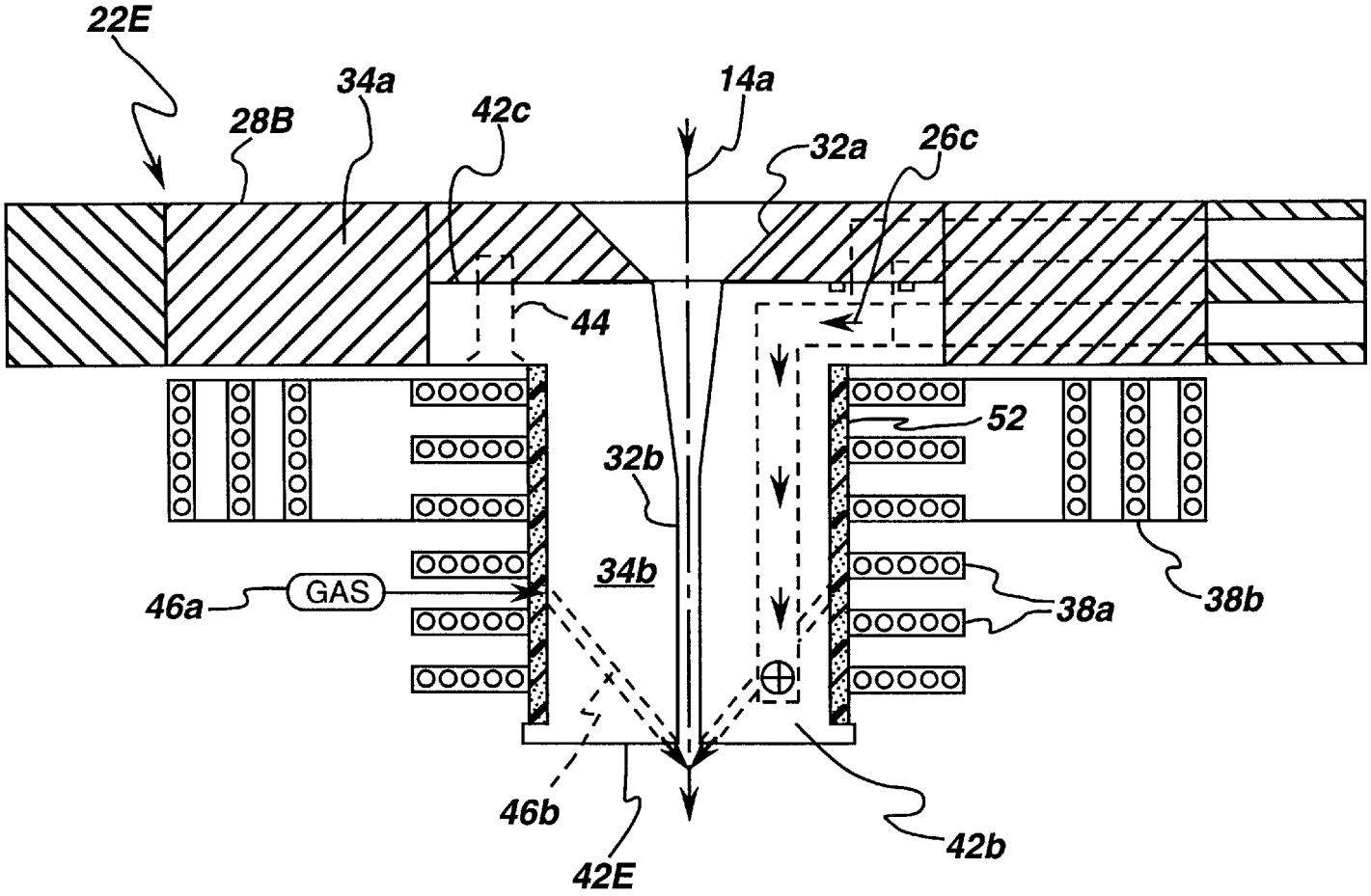
FIG. 11 is an elevational, sectional view of a melt guide in accordance with a fifth embodiment of the present invention having a cylindrical insert disposed in the base plate with integral cooling and atomizing circuits therein.

FIG. 11 illustrates yet another embodiment of the melt guide designated 22E which is similar to the embodiment of the melt guide 22D illustrated in FIGS. 9 and 10, showing an alternate arrangement of the primary and secondary induction heating coils 38*a* and 38*b* as well as exemplary details of the insert cooling means being disposed in flow communication with the plate cooling means for circulating the coolant 26*c* therebetween. Suitable conduits may be drilled through corresponding portions of the base plate 28B and the segmented insert 42E for channeling the coolant 26*c* therethrough. And, the atomizing means may be integrally combined with the insert 42E by providing suitable outlets 46*b*, like those illustrated in FIGS. 7 and 8, through the lower portion of the insert 42E, and disposed in flow communication with the gas supply 46*a* for providing the atomizing gas thereto. In this way, the atomizing gas is closely coupled with the melt 14*a* discharged from the lower end of the extended insert 42E where desired. Furthermore, the cylinder portion 42*b* of the extended insert 42E may be wrapped with conventional fiberglass 52 for providing mechanical hoop strength around the insert 42E for increasing its strength under the thermal and pressure forces generated during operation.

Figure 12:
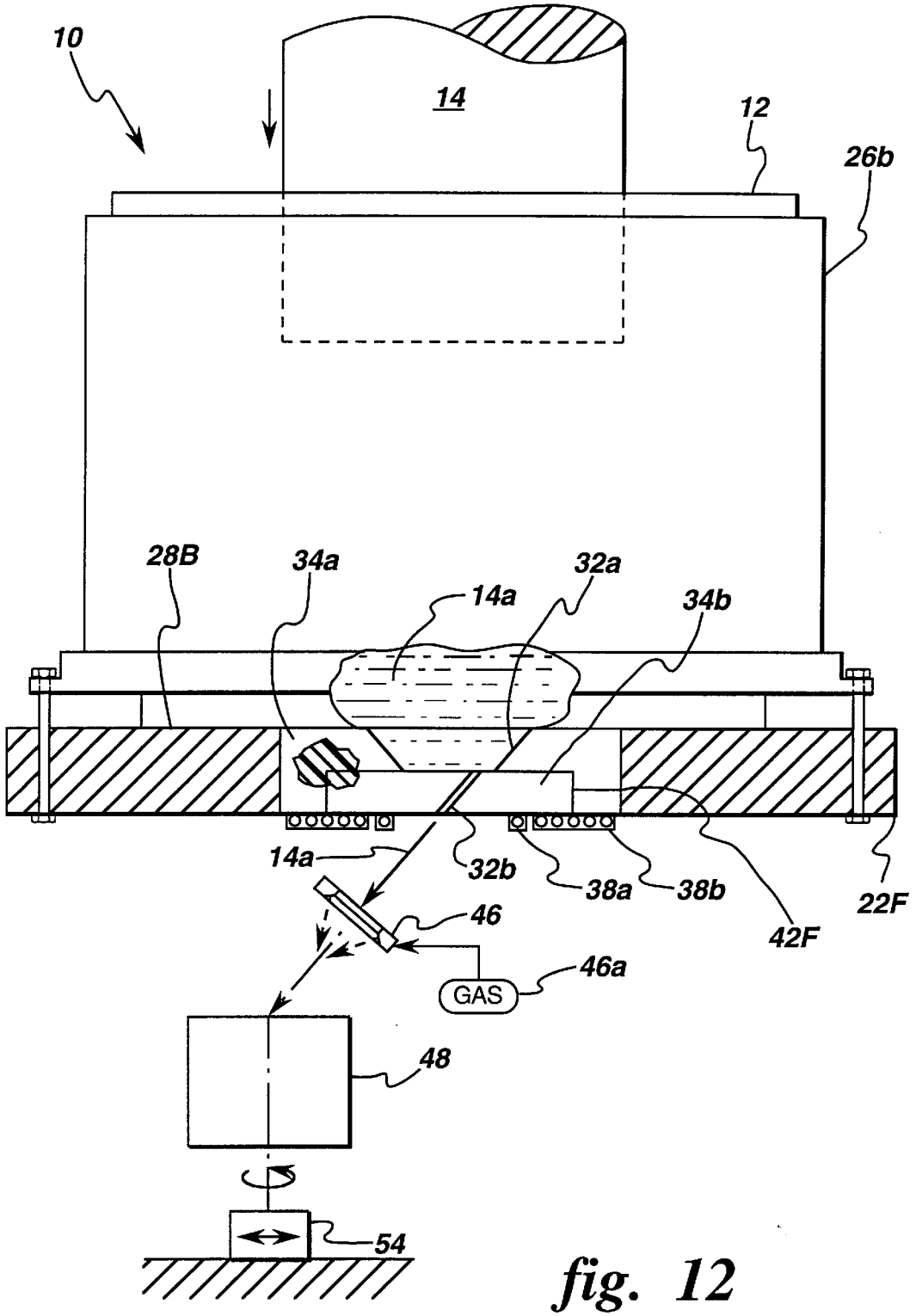
FIG. 12 is a schematic representation of an electroslag refining apparatus including a melt guide in accordance with another embodiment of the present invention having an oblique drain for discharging the refined melt laterally for collection on a vertically mounted collection ingot.

FIG. 12 schematically illustrates the electroslag refining apparatus 10 including a melt guide 22F in yet another embodiment of the present invention which is substantially similar to the melt guide 22B illustrated in FIG. 5, except with the lower drain 32*b* being inclined at an oblique angle to both the upper and lower surfaces of the base plate 28B to discharge the melt 14*a* laterally to the side instead of straight vertically downwardly. This allows a substantial reduction in a complexity of supporting the workpiece 48 and decreases the overall complexity and cost of the entire apparatus. In this embodiment, the collection ingot or workpiece 48 is disposed vertically below the insert 42F and is spaced laterally to the side of the lower drain 32*b*.

Suitable carriage means 54 are provided for rotating the collection ingot 48 about a vertical centerline axis thereof as well as translating the ingot 48 laterally or axially as desired for collecting the melt 14*a* discharged from the lower drain 32*b*. The carriage means 54 may take any suitable form for rotating the ingot 48 as well as translating it horizontally or vertically and is relatively simpler than that used for handling the horizontal or inclined workpiece 48 illustrated in FIG. 1. The conventional atomizing means 46 may also be used between the lower drain 32*b* and the collection ingot 48 for atomizing the melt which is then solidified on the moving ingot 48.

The angled lower drain 32*b* may be relatively easily incorporated into the insert 42F by simple drilling therein. And, the upper and lower slots 34*a* and 34*b* may still be readily easily manufactured using conventional EDM wire forming thereof. The angled lower drain 32*b* is therefore readily manufactured, which is not practical, if not impossible, in the conventional cold finger, funnel-shaped melt guides of the prior art. Additional versatility in processing the angled melt discharged from the lower drain 32*b* is obtained with a correspondingly simple collection apparatus.

The angled lower drain 32*b* illustrated in FIG. 12 may be directly incorporated in the embodiment illustrated in FIG. 2 by simply inclining the single drain 32 illustrated therein if desired.

Figure 13:
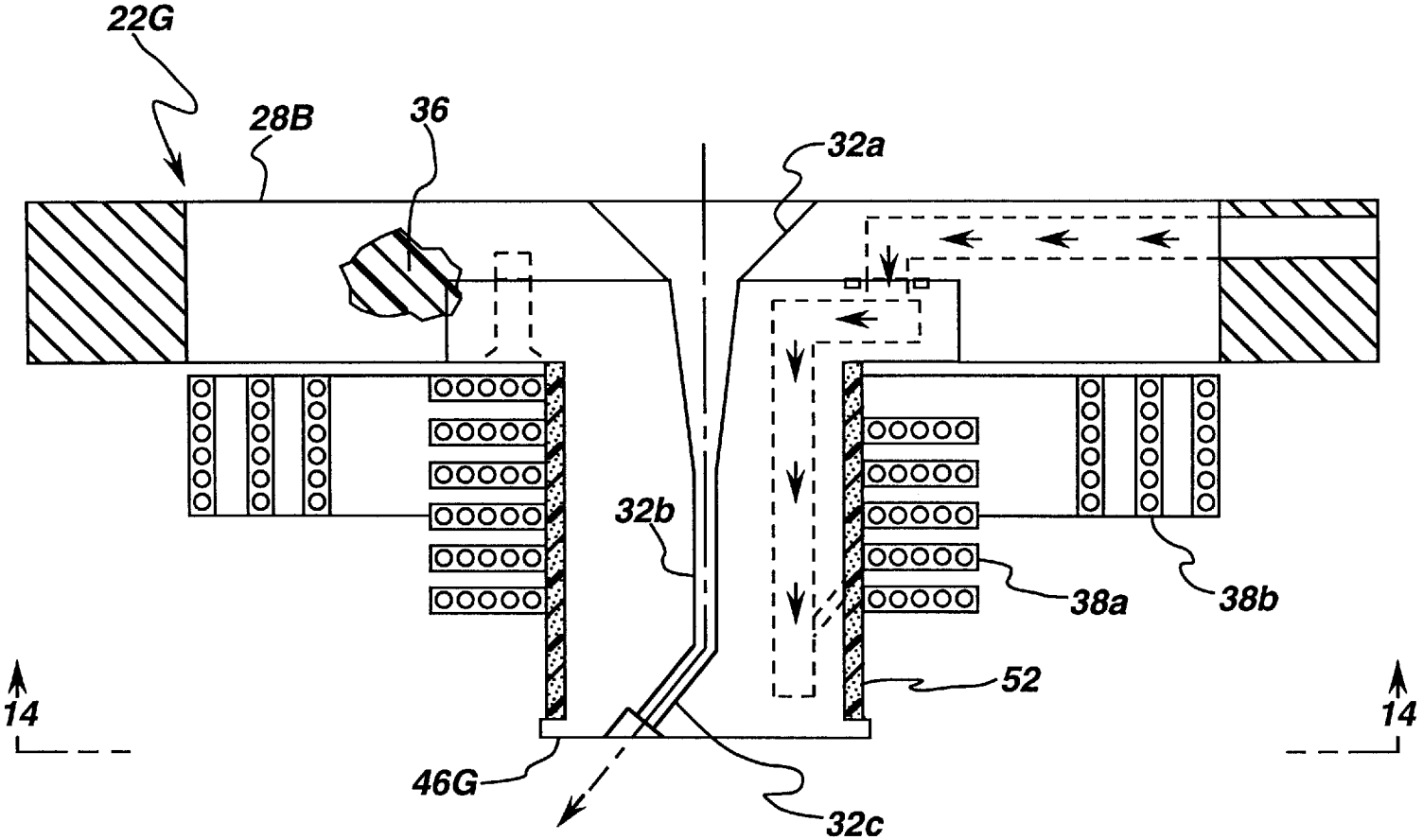
FIG. 13 is an elevational sectional view of a melt guide in accordance with another embodiment of the present invention having a cylindrical insert with an inclined drain outlet at the end thereof for attachment to the crucible illustrated in FIG. 12 for laterally discharging the refined melt on the vertically disposed collection ingot.
Figure 14:
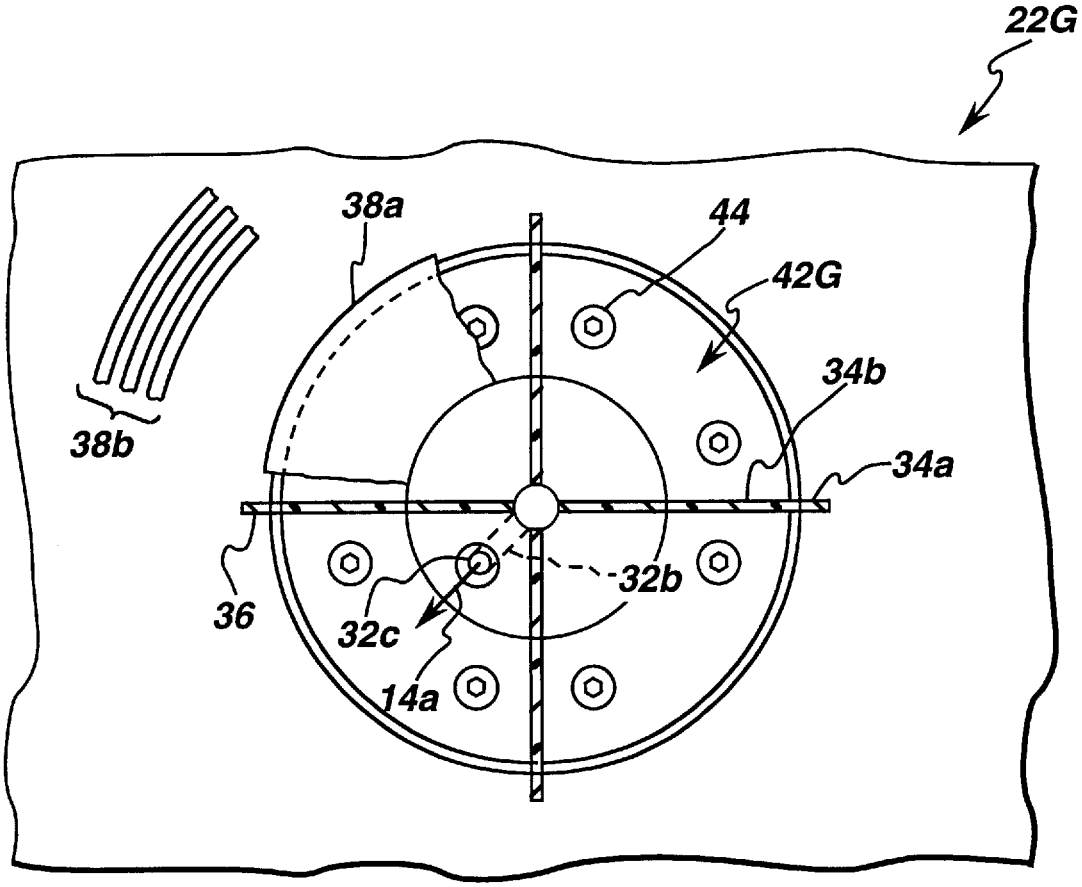
FIG. 14 is a bottom view of portions of the melt guide illustrated in FIG. 13 and taken generally along line 14—14.

The inclined discharge may also be incorporated in alternate configurations such as the melt guide 22G illustrated in FIG. 13 which is substantially identical to the melt guide 22E illustrated in FIG. 11 including an identical base plate 28B and segmented insert 42G similar to insert 42E, except, however, with the lower drain 32*b* having an outlet 32*c* angled obliquely to the insert lower surface for discharging the melt 14*a* laterally at an acute angle from vertical. As shown in FIG. 14, the inclined outlet 32*c* extends radially outwardly from the axial centerline axis of the insert 42G for discharging the melt laterally at an acute angle from vertical. And, the melt guide 22G illustrated in FIGS. 13 and 14 may be readily attached to the crucible 12 illustrated in FIG. 12 for laterally discharging the melt 14*a* for solidification on the collection ingot 48.

In all of the above embodiments, the various melt guides 22 are in the form of simple disks or cylinders made of copper, for example, which are more simply made than the conventional funnel-shaped melt guides. Channels may be simply drilled therein, and the slots simply formed by conventional wire EDM for substantially reducing the cost of manufacture and complexity. The use of separate base plates and inserts improves manufacturability, and further reduces costs since only the inserts need be replace upon wear or to change drain size of inclination. And, controllable performance of the electroslag refining process may be maintained with suitable control of the draining flow rate of the melt 14*a* using the induction heating coils 38. And, lateral discharge of the melt 14*a* is now possible in a simple structure providing further advantages in depositing the melt on a vertically positioned workpiece.

What is claimed is:

1. A melt guide for enclosing a bottom of an electroslag refining crucible containing a melt of electroslag refined metal comprising:

a substantially flat base plate having a perimeter sized to engage said crucible bottom for attachment thereto;

said base plate further including an upper surface for defining with said crucible a reservoir for receiving said melt, and a lower surface spaced below said upper surface;

said base plate further including a central drain extending therethrough for draining by gravity said melt from said reservoir, and a plurality of circumferentially spaced apart slots extending radially outwardly from said drain toward said perimeter and extending vertically through said base plate; and means disposed below said base plate lower surface for induction heating said melt through said slots.

2. A guide according to claim 1 further comprising means for cooling said base plate.

3. A guide according to claim 2 wherein said slots define a plurality of fingers therebetween, and said cooling means include channels extending inside said fingers for circulating a coolant therethrough.

4. A guide according to claim 3 wherein both said upper and lower surfaces are flat and parallel to each other.

5. A guide according to claim 4 wherein said drain is perpendicular to both said upper and lower surfaces.

6. A guide according to claim 4 wherein said drain is oblique to both said upper and lower surfaces.

7. A guide according to claim 4 wherein said heating means comprise cooled electrical coils disposed coaxially about said drain, and extending radially over said slots for transmitting electromagnetic energy through said slots into said melt.

8. A guide according to claim 7 wherein said heating means further comprise independent primary and secondary ones of said coils, with said primary coil being disposed adjacent to said drain for heating said melt discharged therethrough, and said secondary coil being spaced radially outwardly from said primary coil for heating said melt in said reservoir.

9. A guide according to claim 7 further comprising means for atomizing said melt discharged from said drain.

10. A guide according to claim 7 in combination with said crucible to define an electroslag refining apparatus, and further comprising:

means for removably attaching said base plate to said crucible bottom in sealed contact therewith;

means for cooling said crucible;

means for feeding an ingot into said crucible; and means for melting said ingot in said crucible to form said melt.

11. A guide according to claim 3 further comprising:

said base plate including a counterbore disposed in said lower surface around said drain, with said drain defining an upper drain, and said slots defining upper slots;

an insert fixedly joined to said base plate in said counterbore, and having a lower drain disposed in flow communication with said upper drain for channeling said melt therefrom, and a plurality of circumferentially spaced apart lower slots extending radially outwardly from said lower drain and aligned with respective ones of said upper slots for transmitting said electromagnetic energy therethrough to said melt in said reservoir; and said heating means being disposed around said insert for transmitting said energy through said lower and upper slots.

12. A guide according to claim 11 further comprising means for cooling said insert.

13. A guide according to claim 12 wherein said insert comprises a plurality of segments circumferentially spaced apart from each other at respective ones of said lower slots, with each insert segment being fixedly joined to said base plate in said counterbore.

14. A guide according to claim 13 wherein said insert segments collectively define a segmented flat disk including a lower surface between said lower drain and a perimeter of said insert disposed substantially coplanar with said lower surface of said base plate between said counterbore and perimeter thereof.

15. A guide according to claim 14 wherein said insert cooling means are disposed in flow communication with said plate cooling means for circulating a coolant therebetween.

16. A guide according to claim 15 further comprising means for atomizing said melt discharged from said lower drain.

17. A guide according to claim 16 wherein said atomizing means are disposed in part in said insert for injecting an atomizing gas therefrom around said lower drain to atomize said melt upon discharge therefrom.

18. A guide according to claim 17 wherein said atomizing means comprise a plurality of circumferentially spaced apart outlets disposed coaxially with said lower drain in said insert lower surface.

19. A guide according to claim 17 wherein said upper drain in conical, and said lower drain is cylindrical.

20. A guide according to claim 16 wherein said lower drain has an outlet oblique to said insert lower surface for discharging said melt laterally at an acute angle from vertical.

21. A guide according to claim 16 in combination with said crucible to define an electroslag refining apparatus, and further comprising:

means for removably attaching said base plate to said crucible bottom in sealed contact therewith;

means for cooling said crucible;

means for feeding an ingot into said crucible; and means for melting said ingot in said crucible to form said melt.

22. An electroslag apparatus according to claim 21 further comprising:

a collection ingot disposed vertically below said insert, and spaced laterally from said lower drain; and means for rotating said collection ingot about a vertical axis for collecting said melt discharged from said lower drain.

23. A guide according to claim 13 wherein said insert segments collectively define a segmented cylinder extending from a larger diameter flange, with said insert flange being fixedly mounted in said plate counterbore, and said cylinder extending downwardly therefrom.

24. A guide according to claim 23 wherein said heating means further comprise independent primary and secondary ones of said coils with said primary coil being disposed circumferentially around said insert cylinder and said lower drain extending therethrough for heating said melt through said lower slots therein, and said secondary coil being disposed circumferentially around said insert flange for heating said melt in said reservoir through said lower slots in said flange and through said upper slots aligned therewith.

25. A guide according to claim 24 wherein said upper drain and lower drain are coaxial and extend straight through said base plate and insert.

26. A guide according to claim 24 wherein said lower drain includes an inclined outlet extending radially outwardly from an axial centerline axis of said insert for discharging said melt laterally at an acute angle from vertical.

27. A guide according to claim 24 wherein said insert cooling means are disposed in flow communication with said plate cooling means for circulating said coolant therebetween.

28. A guide according to claim 27 further comprising means for atomizing said melt discharged from said lower drain.

29. A guide according to claim 28 wherein said atomizing means are disposed in part in said insert for injecting an atomizing gas therefrom around said lower drain to atomize said melt upon discharge therefrom.

30. A guide according to claim 29 wherein said atomizing means comprise a plurality of circumferentially spaced apart outlets disposed coaxially with said lower drain in said insert lower surface.

31. A guide according to claim 28 in combination with said crucible to define an electroslag refining apparatus, and further comprising:

means for removably attaching said base plate to said crucible bottom in sealed contact therewith;

means for cooling said crucible;

means for feeding an ingot into said crucible; and means for melting said ingot in said crucible to form said melt.

32. An electroslag refining apparatus according to claim 31 wherein said lower drain includes an inclined outlet extending radially outwardly from an axial centerline axis of said insert for discharging said melt laterally at an acute angle from vertical.

33. An apparatus according to claim 32 further comprising:

a collection ingot disposed vertically below said insert, and spaced laterally from said lower drain; and means for rotating said collection ingot about a vertical axis for collecting said melt discharged from said lower drain.

* * * * *